United States Patent [19]

Gundlach

[11] Patent Number: 4,940,655

[45] Date of Patent: Jul. 10, 1990

[54] PHOTOGRAPHIC ANTISTATIC ELEMENT HAVING A BACKING LAYER WITH IMPROVED ADHESION AND ANTISTATIC PROPERTIES

[75] Inventor: Kurt Gundlach, Webster, N.Y.

[73] Assignee: E. I. du Pont de Nemours and Company, Wilmington, Del.

[21] Appl. No.: 190,545

[22] Filed: May 5, 1988

[51] Int. Cl.[5] ..... G03C 1/76

[52] U.S. Cl. ..... 430/523; 430/527; 430/539

[58] Field of Search ..... 430/527, 539, 523

[56] References Cited

U.S. PATENT DOCUMENTS

| | | | |
|---|---|---|---|
| 4,225,665 | 9/1980 | Schadt | 430/529 |
| 4,301,240 | 11/1981 | Bruch et al. | 430/527 |
| 4,585,730 | 4/1986 | Cho | 430/527 |
| 4,701,403 | 10/1987 | Miller | 430/529 |

*Primary Examiner*—Jack P. Brammer

[57] ABSTRACT

A photographic film having an auxiliary backing layer coated over an antistatic layer is described. This auxiliary layer contains an adhesion promoting amount of an aqueous dispersion of a polymerized vinyl compound, e.g. acrylate latex, which is added to the auxiliary layer composition after final adjustment of the pH thereof and just prior to coating. The film is useful in the areas of graphic arts, printing, medical systems and information systems.

8 Claims, No Drawings

PHOTOGRAPHIC ANTISTATIC ELEMENT HAVING A BACKING LAYER WITH IMPROVED ADHESION AND ANTISTATIC PROPERTIES

BACKGROUND OF THE INVENTION

CROSS-REFERENCE TO RELATED APPLICATIONS

This application is related to Cho U.S. Pat. No. 4,585,730. "Antistatic Backing Layer with Auxiliary Layer for a Silver Halide Element", April 29, 1986 and is an improvement thereon. This application is also related to Miller U.S. Pat. No. 4,701,403, "Two Layer Process for Applying Antistatic Compositions to Polyester Supports." Oct. 20, 1987, which describes a useful antistatic layer over which the layer of this invention may be applied.

This application is also related to co-pending application. U.S. Ser. No. 07/126,524, filed Nov. 30, 1987. which describes a method for improving adhesion between backing auxiliary layers and layers applied previously to the support.

FIELD OF THE INVENTION

This invention relates to photographic elements. More particularly this invention relates to photographic films having antistatic layers applied thereon. Still more particularly, this invention relates to photographic films having auxiliary backing layers that can conduct antistatic properties from an antistatic underlayer to the surface thereof and which exhibit substantially improved static protection and greatly improved adhesion in the unexposed, exposed and processed states.

BACKGROUND ART

Polymeric film supports for photographic film are known for their propensity to accumulate static charges. This is a particular problem where the film is designed to be handled by machine and to be processed rapidly over unlike surfaces. Static charges which may be generated at this time cannot be readily tolerated because discharging these may expose the photographic layer, or layers, coated thereon.

The use of so-called antistatic layers to prevent the build-up of these static charges is well known in the art. Schadt U.S. Pat. No. 4,225,665, describes one such composition comprising a mixture of (1) a water-soluble copolymer of the sodium salt of styrene sulfonic acid and a carboxyl-containing monomer, (2) a hydrophobic polymer containing carboxyl groups, and (3) a water-soluble polyfunctional aziridine. When this mixture is applied as a single layer to resin-subbed (resin-subcoated)poly(ethylene terephthalate), for example, it provides excellent protection from the build-up of static charges (e.q., surface resistivity).

Miller U.S. Pat. No. 4,701,403 describes an improvement over the aforementioned Schadt patent wherein a polymer such as component (1), for example, is applied to the support in a first coating optionally a composition containing component (2), and, after drying, aziridine component (3) is applied as a second coating contiguous thereto. This improved process permits the application of improved thinner antistatic layers without premature reaction of the aziridine with the other ingredients. Products from such premature reaction can sometimes plug and foul coating equipment, which is not commercially tolerable.

Cho U.S. Pat. No. 4,585,730 describes an auxiliary layer containing a conductive polymer as described therein. This layer is satisfactory in transporting antistatic properties from underlayers to the surface thereof. However, occasionally the layer described in this patent suffers from certain disadvantages such as problems with anchorage and poor processability in the fluids in which the photographic layer is processed.

Copending application U.S. Ser. No. 07/126,524, filed Nov. 30, 1987, describes an auxiliary layer containing at least one crosslinkable conductive polymer as described therein and a crosslinking agent for the conductive polymer. This layer has satisfactory dry anchorage, but suffers from certain disadvantages such as reduced static protection and manufacturing difficulties such as reagent degradation and plugging of the coating equipment.

Thus, it is desired to provide an auxiliary layer which can be coated over antistatic layers and which will conduct antistatic properties to the surface thereof. Such a layer also will serve as a backing layer for a photographic film which contains an antistatic layer thereon. It is also desired to provide such a layer with good anchorage to previously applied layers and which will be stable after processing in standard photographic processing chemistry. Still further, it is desired to provide an auxiliary layer with improved static protection.

SUMMARY OF THE INVENTION

In accordance with this invention there is provided a photosensitive film comprising a support, at least one photosensitive composition coated on one side of said support, an antistatic layer coated on the opposite side of said support, and coated over said antistatic layer an auxiliary layer consisting essentially of a dispersion of gelatin, at least one hardener, at least one dispersing agent and an adhesion promoting amount of an aqueous dispersion of a polymerized vinyl compound, with the proviso that said adhesion promoting vinyl compound is added to said auxiliary layer dispersion after the pH is adjusted to 5 to 7.

DETAILED DESCRIPTION OF THE INVENTION

The auxiliary layer contains gelatin. The gelatin may contain substitutes, e.g., polyvinyl alcohol, dextran, cellulose derivatives, modified gelatins, a water-soluble latex, etc., which may be present in minor amounts, e.g. less than 17% by weight.

Cross-linking agents or hardeners useful within the ambit of this invention include, for example, aldehydes and polyfunctional aziridines such as those described in Schadt U.S. Pat. No. 4,225,665 and Miller U.S. Pat. No. 4,701,403. The disclosures of these two patents relating to the aziridines are incorporated herein by reference. A preferred polyfunctional aziridine crosslinking agent is pentaerythritol-tri-beta-(2-methyl aziridine) propionate which may be added to the gelatin binder in an amount of about 0.5 to about 2.5% by weight of the gelatin binder and preferably in an amount of about 1.0 to about 1.5% by weight. Aldehydes may be present in the range of about 0.5% by weight to about 5.0% by weight of the gelatin binder. A particularly preferred cross-linking agent or hardener is formaldehyde which may be present in the range of about 0.5% by weight to about 2.0% by weight of the gelatin binder and preferably in the range of about 0.75% to about 1.25% by weight of said binder. Other commonly used cross-linking agents and gelatin hardeners common in the field of photosensitive elements may also be used within he ambit of this invention.

Aqueous polymeric vinyl compounds which may be used in this invention are described in Nottorf, U.S. Pat. No. 3,142,568, July 28, 1964. The disclosure of this patent relating to aqueous polymeric vinyl compounds and amphoteric dispersing agents is incorporated herein by reference. Preferred polymeric vinyl compounds are acrylic acid esters selected from the group consisting of a homopolymer of an acrylic acid ester, a homopolymer of an alpha-hydrocarbon substituted acrylic acid ester and a copolymer of said acrylic acid esters, said copolymer containing at least 90% by weight said acrylic acid esters. These compounds, in the form of a hydrosol or colloidal dispersion, are usually dispersed using amphoteric dispersing agents as fully described in the aforementioned Nottorf reference. The aqueous dispersion of a polymerized vinyl compound is present in an adhesion promoting amount. By "adhesion promoting amount" is meant the amount sufficient to insure the layers do not delaminate during automatic processing. I have found that this amount may include an amount of about 48 to about 128 g, preferably 74 to 80 g, per 200 g of gelatin binder in the auxiliary layer.

When the polymeric vinyl compounds are dispersed in water, as described above, a latex of these compounds is formed. In addition to the dispersing agents present in said latex, at least one additional dispersing agent must be present in the gelatin dispersion to insure that the integrity of the latex is maintained when said latex is added thereto. Dispersing agents useful within the ambit of this invention are legion in number. Particularly preferred is a mixture of sodium myristyl triether sulfate, an anionic fluorocarbon surfactant and a sodium octyl phenoxy diethyl sulfonate. Other mixtures of surfactants may also be used.

In the auxiliary layer of this invention, there may be present at least one other conductive polymer which may have crosslinkable groups. A particularly preferred conductive polymer is cationic conductive polymer 261-RV, a quarternary ammonium chloride polymer. Other useful conductive polymers include: hexadecyl betaine, alkyldimethyl betaines wherein alkyl is 1 to 12 carbon atoms, carboxylated imidazolines, coco amido betaines, etc. These conductive polymers which contain functionally attached carboxylic acid groups may be added to the auxiliary layer of this invention in a range of about 1 to 10% by weight of the gelatin binder and preferably at about 4 to about 6% by weight.

A mixture of the gelatin in water, at least one dispersing agent and the cross-linking agent or hardeners of this invention is made up prior to coating. Other additives such as antihalation dyes, conductive polymers and other hardeners, for example, may also be present. At this point, just prior to coating, the pH of the mixture is adjusted to 5.0 to 7.0, and preferably to 6.0. Then, the aqueous dispersion of a polymerized vinyl compound is added to the pH adjusted mixture.

The aqueous coating composition made as described above may be applied with good results to any of the conventional photosensitive film supports but the preferred support is poly(ethylene terephthalate) subcoated with a layer or layers of conventional resins and bearing on one side a photosensitive layer, preferably a silver halide emulsion layer, and on the other side as a backing layer a layer of an antistatic composition, e.g., antistatic coatings of Schadt U.S. Pat. No. 4,225,665, Miller U.S. Pat. No. 4,701,403, etc. The invention is not limited to any particular antistatic coating; however the antistatic coatings of Miller, U.S. Pat. No. 4,701,403 are preferred (see particularly column 3, line 56 to column 4, line 56, the disclosure of which is incorporated herein by reference). The backing layer of this invention is then coated over the antistatic layer at a coating weight of about 30 to about 60 mg gel/dm$^2$, preferably about 33 to 51 mg gel/dm$^2$.

Thus, in a particularly preferred mode, this invention is represented by a photographic film element which comprises a support, which is preferably dimensionally stable polyethylene terephthalate suitably subbed on both sides with a thin, anchoring substratum of a conventional resin sub over which may be applied a gelatin sublayer. On one side of this support a standard silver halide emulsion layer is applied and this layer is overcoated with a conventional gelatin abrasion layer. On the side opposite to the side containing this emulsion layer, the antistatic layer of the aforementioned Miller patent is preferably applied followed by a layer represented by this invention. As stated previously, the layer of this invention, containing the large amounts of aqueous polymeric vinyl compound added after adjustment of the pH, may be an antihalation layer or may be coated simply as an anti-curl layer, as is well-known to those of normal skill in the art.

When the layer of this invention is made as taught herein many advantages are obtained. First, this layer will provide greatly improved antistatic properties on the surface of the film as is desired. Next, this layer is stable and will survive the rigors of photographic processing without delamination of the various layers, one from another. This is a very desirable trait since prior art layers tended to flake off during the processing steps. This loss of layer integrity is a defect that cannot be tolerated since particles of the layer tend to adhere to processing rollers and thus transfer to films subsequently processed thereon. Additionally the adhesion between previously coated or subsequently coated layers is enhanced by the layer of this invention over those of the prior art. This is a surprising result since layers very similar to that described herein, which exhibit a desired hardness, among others and are satisfactory in transmitting the antistatic properties, do not have the characteristics described above. Finally, when automatic processing machines are used to process the film, these layers will survive intact and will not delaminate when bent or forced via rollers and the like usually present in said automatic processing machines.

A host of conventional photosensitive compositions may be used in this invention. These include photopolymer, diazo vesicular image-forming materials etc. The films described may be used in any of the well-known imaging fields such as graphic arts printing, medical and information systems among others. The photographic film of this invention is particularly useful in processes where rapid transport and handling by machines are practiced such as phototypesetting applications, for example. Particularly useful elements include the so-called "bright-light" films which can be handled in relatively bright safelights, for example, This invention will now be illustrated but not limited by the following examples wherein the percentages are by weight. Example 1 is considered to be the best mode.

EXAMPLE 1

The following solution representing a backing layer within the ambit of this invention was prepared by mixing 1200 gm of gelatin (K&K lime bone Blend #2964), 10,684 gm of distilled water and 240 gm of a conductive polymer solution (5% aqueous 261-RV quaternary ammonium chloride polymer manufactured by Calgon Corp., Pittsburgh, PA). This material was stirred for 20 minutes at room temperature and then heated to 130° F. with stirring for an additional 30 minutes. This mixture was then cooled to 115° F. and the following ingredients were added thereto:

| Ingredient | Amt. (gm) |
|---|---|
| 4.2% aqueous solution of sodium octyl phenoxy diethyl sulfonate wetting agent (Triton ® X200, Rohm & Haas Co., Philadelphia, PA.) | 600 |
| Methyl Alcohol | 375 |
| 18.5% aqueous solution of S-1240 Dye (see below) | 183 |
| 10% aqueous solution of Acid Violet-520 Dye (see below) | 77 |
| 9.5% aqueous solution of sodium myristyl triether sulfate wetting agent (Standapol ® ES40, Henkel, Inc., Hoboken, NJ) | 720 |
| 8.1% aqueous solution of FC-127 (fluorocarbon anionic surfactant, 3M Co., St. Paul, MN., pH = 7.0 to 7.5) | 270 |
| 16.8% aqueous solution of synthetic silica #72 dispersed in a 6.7% aqueous solution of gelatin (Davison Chem. Co., Div. W. R. Grace & Co., Cincinnati, OH) | 4.6 |
| Distilled Water | 8.2 |
| 3.7 wt. % aqueous $CH_2O$ solution | 332.6 |

S-1240 Dye has the following structure:

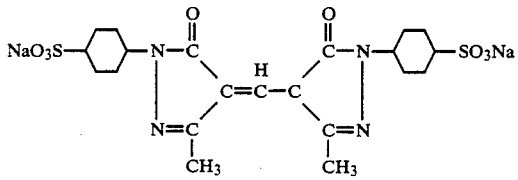

Acid Violet-520 Dye has the following structure:

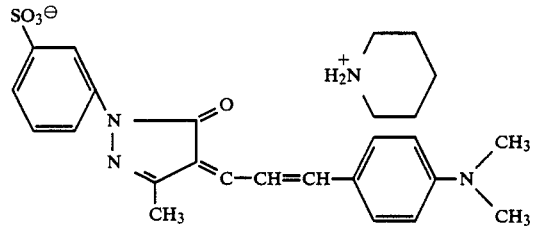

The pH of this mixture was adjusted to 5.0 with 1.5 molar aqueous sulfuric acid, or to 6.0 to 7.0 with 10.7% aqueous sodium hydroxide depending on the initial pH followed by the addition of an aqueous latex dispersion. CP-31, (31–34% aqueous polyethyl acrylate latex, pH=7.5–8.5, containing 10.6% of the aforementioned Tritone ® X200 wetting agent. A total of 1440 gm of this latex dispersion was added.

A 4-mil dimensionally stable polyethylene terephthalate film support having a conventional resin sublayer coated on both sides thereof, was prepared. An antistatic layer prepared according to Miller, U.S. Ser. No. 07/075,454, filed July, 20, 1987, Example 1, was applied on one side thereof followed by a layer made by coating the above solution. The antistatic layer was 4.2 mg/dm$^2$ in terms of VERSA-TL4 (sodium salts of sulfonated styrene (85%) and maleic anhydride (15%), copolymer, 82% weight total solids) thick and the backing layer of this invention was coated at a thickness of 36 mg/dm$^2$, based on gelatin present. This film and the coating were then thoroughly dried and samples taken therefrom for testing. For control purposes, samples of a film made according to the procedure described above but with no latex added and an equivalent weight of distilled water substituted therefore, were taken. Each of these samples were tested by using a device which simulates the rollers of a Du Pont Automatic Processor Type 44C. In this configuration as in other conventional automatic processors, the film passes through some opposed rollers to cross-over from the developer to the fixer. During this process, considerable strain is applied to the developer-soaked film causing delamination between layers. In simulation thereof, a pair of stainless steel rollers with a drive mechanism were set up with a device which can assert a measured amount of pressure thereon. This device, then, can exert uneven pressure to simulate that caused in the processor. Samples of films from above were first soaked in a conventional developer solution for 30 seconds at 108° F. and then passed through the aforementioned rollers. A pressure of approximately 20 lbs. was applied to one end of this device as the film strips were passing. In the case of all of the controls, edge delamination was noted. In the case of the film representing this invention no delamination was noted. Additionally the film of this invention had less of a propensity to generate a static charge compared to the controls.

TABLE 1

| Sample | Processed Charge Decay ½ Life at RH = 18%, Dry Bulb = 68° F. | Avg. Anchorage(1) |
|---|---|---|
| Control = No latex | 21.0 | 2.75 |
| Of this Invention | 3.4 | 1.0 |

(1)Where 1.0 is no delamination, 5.0 is continous edge delamination, and 10.0 is total backing failure.
RH stands for Relative Humidity This example illustrates that films of this invention have more than 100% reduction in propensity to produce static and with no delamination occurring thereon.

EXAMPLE 2

The following solution representing a backing layer within the ambit of this invention was prepared by mixing 1200 gm. of gelatin (K&K lime bone Blend #2964), 10,250 gm. of distilled water and 240 gm. of a conductive polymer solution (5% aqueous 261-RV quaternary ammonium chloride polymer manufactured by Calgon Corp., Pittsburgh. PA). This material was stirred for 20 min. at room temperature and then heated to 130° F. with stirring for an additional 30 minutes. This mixture was then cooled to 115° F. and the following ingredients were added thereto:

| Ingredient | Amt. (gm.) |
|---|---|
| 14.8% aqueous solution to Polystep B27 wetting agent (sodium salt of a sulfated nonylphenoxy polyethyl ethanol containing 4.0 moles of ethylene oxide, Stepan Co., Northfield, IL) | 240 |
| 16.8% aqueous solution of synthetic silica #72 dispersed in a 6.7% aqueous solution of gelatin (Davidson Chem. Div. W R. Grace & Co., Cincinnati, OH) previously mixed with 7.5 aqueous wt. % BCO (C-Hexyl and Decyl Betaines, E. I. du Pont de Nemours & Co. Inc. Chemicals and Pigments Division, Chamberworks, Deepwater, NJ) and heated to 100° F. with occasional stirring for 60 minutes prior to addition | 4.7<br>52 |
| Distilled Water | 381 |
| Methyl Alcohol | 373 |
| 18.5% aqueous solution of S-1240 Dye (see structure given in Example 1) | 183 |
| 10% aqueous solution of Acid Violet-520 Dye (see structure given in Example 1) | 77 |
| 9.5% aqueous solution of sodium myristyl triether sulfate wetting agent (Standapol ® ES40, Henkel Inc., Hoboken, NJ) | 720 |
| 8.1% aqueous solution of FC-127, pH = 7.0 to 7.5 (fluorocarbon anionic surfactant, 3M Co., St. Paul, MN) | 270 |
| 3.7 wt. % aqueous $CH_2O$ solution | 332.6 |

The pH of the mixture was adjusted to 5.0 with 1.5 molar aqueous sulfuric acid, 6.0, or to 7.0 with 10.7% aqueous sodium hydroxide depending on the initial pH thereof, followed by the addition of an aqueous latex dispersion CP-31 (31–34% aqueous polyethyl acrylate latex, pH=7.5 to 8.5, containing 10 6% of the aforementioned Triton ® X200 wetting agent). A total of 1440 gm. of this latex dispersion was added. This solution was coated on film as described in Example 1. Samples of the films were tested as described in Example 1 with the following results:

TABLE 2

| Sample | Processed Charge Decay ½ Life at RH = 16%, Dry Bulb = 66° F. | Avg. Anchorage(1) |
|---|---|---|
| Control (same as Example 1) | 68.2 | 3.4 |
| Of this Invention | 40.1 | 1.3 |

EXAMPLE 3

Same as Example 1 except aqueous latex dispersion CP-31 was replaced by 1440 gm. of aqueous latex dispersion CP-16 (30.0–33.5% aqueous polyethyl acrylate latex, pH=5.7 to 7.4, containing 4.4% wetting agent Dupanol WAQE (30% aqueous sodium laurel sulfate). Results on film strips made from the coating of this Example were similar to those of Example 1.

EXAMPLE 4

Same as Example 2 except aqueous latex dispersion CP-31 was replaced by 1440 gm. of aforementioned aqueous latex dispersion CP-16. Results are similar to those achieved in Example 2.

EXAMPLE 5

Same as Example 1 except addition of 123 gm. methyl alcohol solution of pentaerythritol-tri-beta-(2-methyl aziridine) propionate (15 gm. aforementioned polyfunctional aziridine mixed with 108 gm. methyl alcohol) prior to pH adjustment followed by addition of 1440 gm. latex dispersion CP-31. Good results in anchorage and static protection were obtained.

EXAMPLE 6

Same as Example 1 except no conductive polymer (261-RV quarternary ammonium chloride polymer). Instead 240 gm of distilled water (equivalent volume) was added. Good results in anchorage and static protection were obtained.

EXAMPLE 7

Example 1 was repeated with varying levels of latex as shown in the table below. Results of film strips tested as in Example 1 are also shown.

TABLE 3

| Sample | Amt. Latex Added (gm/1200 gm gel) | Processed Charge Decay ½ Life at RH = 18%, DB = 68° F. | Anchorage |
|---|---|---|---|
| 1 | 0 | 65.0 | 4 |
| 2 | 48.8 | 81.5 | 3 |
| 3 | 65.0 | 49.4 | 3 |
| 4 | 78.0 | 38.6 | 1 |
| 5 | 130.0 | 30.3 | 1 |

DB stands for Dry Bulb.

What is claimed is:

1. A photosensitive film element comprising a support, at least one gelatino silver halide emulsion composition coated on one side of said support, an antistatic layer coated on the opposite side of said support, and coated over said antistatic layer an auxiliary layer consisting essentially of an aqueous dispersion of gelatin, at least one gelatin cross-linking agent, at least one dispersing agent and an adhesion promoting amount of an aqueous dispersion of a polymerized vinyl compound, with the proviso that said adhesion promoting vinyl compound is added to said auxiliary layer dispersion after the pH is adjusted to 5 to 7.

2. The element of claim 1 wherein said support is dimensionally stable polyethylene terephthalate.

3. The film of claim 2 wherein said polymerized vinyl compound is selected from the group consisting of a homopolymer of an acrylic acid ester, a homopolymer of an alpha-hydrocarbon substituted acrylic acid ester and a copolymer of said acrylic acid esters, said copolymer containing at least 90% by weight said acrylic acid esters.

4. The film of claim 3 wherein said homopolymer of an acrylic acid ester is polyethyl acrylate.

5. The film of claim 4 wherein said polyethyl acrylate is present in an amount of 32% to 48% by weight based on the gelatin.

6. The film of claim 2 wherein said hardener is formaldehyde,

7. The film of claim 2 wherein said hardener is added to the auxiliary layer dispersion immediately prior to adjustment of the pH to 5 to 7.

8. The film of claim 3 wherein said dispersing agent is a mixture of sodium myristyl triether sulfate an anionic fluorocarbon surfactant and an octyl phenoxydiethyl sulfonate sodium salt.

* * * * *